US006478353B1

(12) United States Patent
Barrozo

(10) Patent No.: US 6,478,353 B1
(45) Date of Patent: Nov. 12, 2002

(54) UNIVERSAL WHEEL TRANSPORT HOOK

(75) Inventor: Glenn T. Barrozo, Howell, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 0 days.

(21) Appl. No.: 09/521,923

(22) Filed: Mar. 9, 2000

Related U.S. Application Data

(60) Provisional application No. 60/124,081, filed on Mar. 12, 1999.

(51) Int. Cl.[7] ..... B66C 1/22

(52) U.S. Cl. ..... 294/67.2; 198/687.1; 211/113; 294/67.1; 294/82.1

(58) Field of Search ..... 294/67.1, 67.2, 294/67.22, 82.1, 82.17, 85, 87.1; 118/500, 502, 503; 211/23, 24, 113; 198/465.4, 485.1, 486.1, 687.1; 248/304, 305, 316.1, 317, 339, 340

(56) References Cited

U.S. PATENT DOCUMENTS 1,433,019 A * 10/1922 McMillin ..... 294/67.22 X
2,141,125 A * 12/1938 Braune ..... 198/465.4
2,889,169 A * 6/1959 Soncrant ..... 294/67.1 X
3,291,519 A * 12/1966 Burke ..... 294/67.2
3,450,428 A * 6/1969 Zimmerman ..... 294/82.1
3,517,959 A * 6/1970 Ferguson ..... 294/67.22
3,749,437 A * 7/1973 Lynn ..... 294/67.2 X
3,900,110 A * 8/1975 Soroka ..... 211/113
3,960,264 A 6/1976 Carbine et al.
4,167,996 A 9/1979 Cutter

* cited by examiner

*Primary Examiner*—Johnny D. Cherry
(74) *Attorney, Agent, or Firm*—MacMillan, Sobanski & Todd, LLC

(57) ABSTRACT

A universal wheel transport hook includes a body portion having a suspension hook formed in one end and a C-shaped cradle formed in the other end. A spacer portion is formed between the suspension hook and the C-shaped cradle. At least one retaining clip and retaining bar assembly is mounted upon the body portion between the spacer portion and the C-shaped cradle. At least one retaining pad is mounted upon the C-shaped cradle.

13 Claims, 3 Drawing Sheets

UNIVERSAL WHEEL TRANSPORT HOOK

CROSS REFERENCE TO RELATED APPLICATIONS

This application claims the benefit of U.S. Provisional Application No. 60/124,081, filed on Mar. 12, 1999.

BACKGROUND OF THE INVENTION

This invention relates in general to the manufacture of vehicle wheels and in particular to a universal hook for transporting wheels within a wheel manufacturing facility.

Cast vehicle wheels and cast vehicle wheel components are becoming increasingly popular. Such wheels are cast upon highly automated casting machines. The wheel castings are then machined to a final shape. The finished wheels are typically coated by a layer of paint and/or a layer of clear coat for an enhanced appearance of the wheel and for protection of the wheel surface. The paint or clear coat is usually sprayed onto the wheel and then cured in an oven. Prior to spraying, the wheel is prepared, or pretreated, by being dipped in vats of cleaning solution to remove any grease and cutting oil remaining upon the wheel surface from the machining process.

To reduce manufacturing time and labor costs, the wheels are usually transported between work stations by hooks suspended from overhead conveyors. The wheels are loaded upon the hooks and then transported by the conveyors through the vats of cleaning solution, spray booths and curing ovens. Thus, a continuous process is provided for finishing the wheels.

SUMMARY OF THE INVENTION

This invention relates to a universal hook for transporting vehicle wheels within a wheel manufacturing facility.

Referring now to the drawings, there are illustrated in FIG. 1 three typical hooks which are currently used for transporting a vehicle wheel within a wheel manufacturing facility. FIG. 1A illustrates a hook 10 which is utilized to carry two automobile vehicle wheels through a clear coating booth. The hook includes a body portion 11 which has a suspension hook 12 formed at the upper end thereof The suspension hook 12 is attached to an overhead conveyor which moves the wheel about the wheel manufacturing facility. The hook 10 further includes upper and lower extensions, 13 and 14, respectively, which terminate in curved upper and lower wheel support hooks, 15 and 16, respectively. A cross bar 17 is mounted transverse to the extensions 13 and 14 below the wheel support hooks 15 and 16. The wheel support hooks 15 and 16 cooperate with the cross bars 17 to receive a wheel rim tire bead retaining flange (not shown) and thereby retain a wheel upon the hook 10. The hook body 11 includes upper and lower trapezoidal wheel rests, 18 and 19, respectively, against which an end of the wheel rests. The hook 10 illustrated in FIG. 1A can support two automobile wheels, with a first wheel carried by the upper wheel hook 15 and a second wheel carried by the lower wheel hook 16.

FIG. 1B illustrates an alternate automobile wheel hook 20 which can be used for transporting wheel castings or machined wheels about a wheel manufacturing facility. The hook also is used to move machined wheels through paint pretreatment vats and a base paint booth. Portions of the hook which are similar to portions of the hook 10 shown in FIG. 1A have the same numerical designators. The hook 20 includes a generally straight body portion 21. Upper and lower pairs of inverted U-shaped clamps, 22 and 23, respectively, are mounted upon the body portion 21. The lower clamp in each pair cooperates with the corresponding cross bar 17 to receive the end of a wheel casting while the upper clamp in each pair cooperates with the corresponding lower clamp to receive the tire bead retaining flange of a finished wheel. A pair of support bars 24, which are transverse to the hook body portion 21, support the inboard or outboard end of the wheel. As in the hook 10 shown in FIG. 1A, the hook 20 can carry two wheels.

FIG. 1C illustrates a hook 30 for transporting motorcycle wheels, which have narrower width than automobile wheels. The hook 30 has a lower portion which is formed as a cradle 31. The cradle 31 receives one motorcycle wheel (not shown). A pair of retaining pads 32 are mounted upon the lower portion of the cradle 31. The motorcycle wheel well is nested within the cradle 31 with the retaining pads 32 being received between the tire bead retaining flanges to retain the motorcycle wheel upon the hook 30. Accordingly, the hook 30 is limited to carrying a single motorcycle wheel.

As shown in FIG. 1, three different hooks are required to transport wheels about a wheel manufacturing facility. Accordingly, when production is changed at the facility, it is also necessary to change the wheel hooks. The unused hooks then must be stored. It is also necessary to transfer the wheels between hooks if the wheels receive both a base coat of paint and a final clear coat. Additionally, the capacity of the hook used for motorcycle wheels is half of the capacity of the hooks used for automobile wheels. Accordingly, it would be desirable to provide a higher capacity hook which could carry both automobile and motorcycle wheels.

The present invention contemplates a universal wheel transport hook which includes a body portion having a first end formed as a suspension hook and a second end formed as a C-shaped cradle. At least one retaining pad is mounted upon the C-shaped cradle. Also, at least one retaining clip is attached to the body portion between the suspension hook and the C-shaped cradle and a retaining bar is mounted transversely upon the retaining clip. The invention further contemplates that the wheel transport hook can include a plurality of C-shaped cradles and retaining pads. Additionally, a pair of retaining clips and bars would be mounted adjacent to each of the C-shaped cradles.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1A:
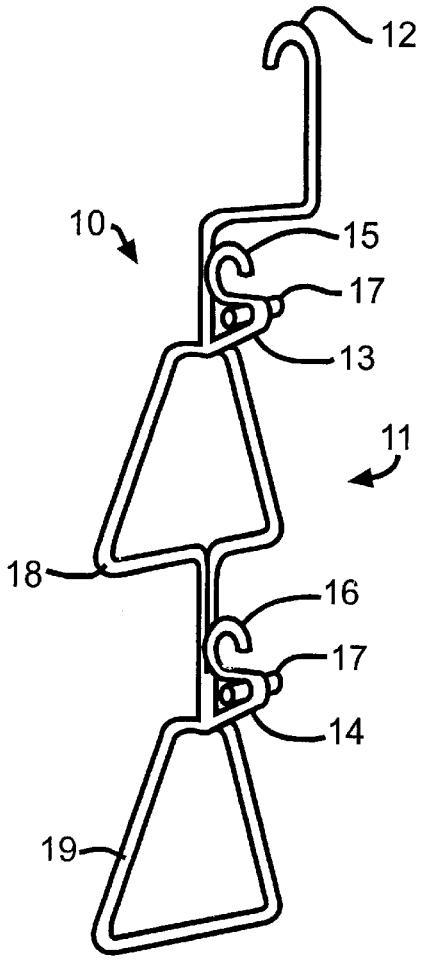
FIG.1A (PRIOR ART)
FIG. 1A is a perspective view of a prior art transport hook for a vehicle wheel.
Figure 1B:
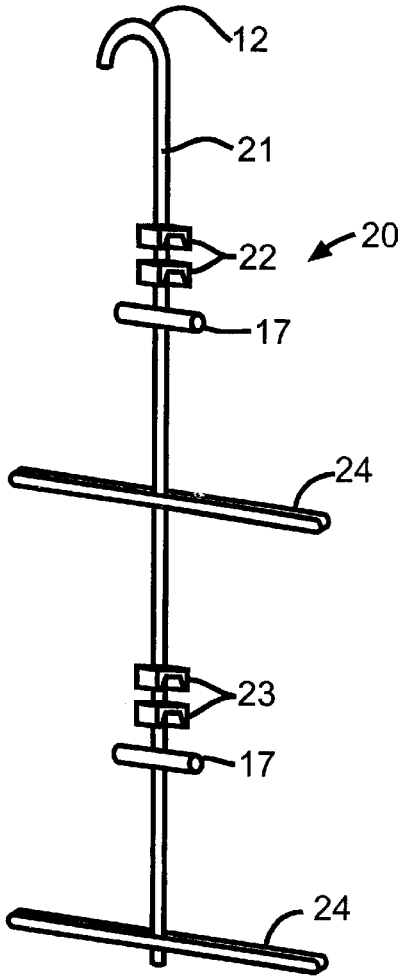
FIG.1B (PRIOR ART)
FIG. 1B is a perspective view of an alternate embodiment of the prior art transport hook shown in FIG. 1A.
Figure 1C:
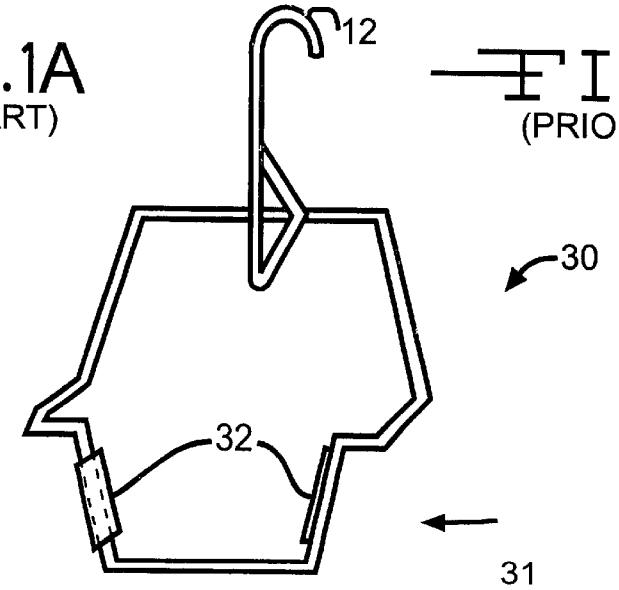
FIG.1C (PRIOR ART)
FIG. 1C is a perspective view of another alternate embodiment of the prior art transport hook shown in FIG. 1A.
Figure 2:
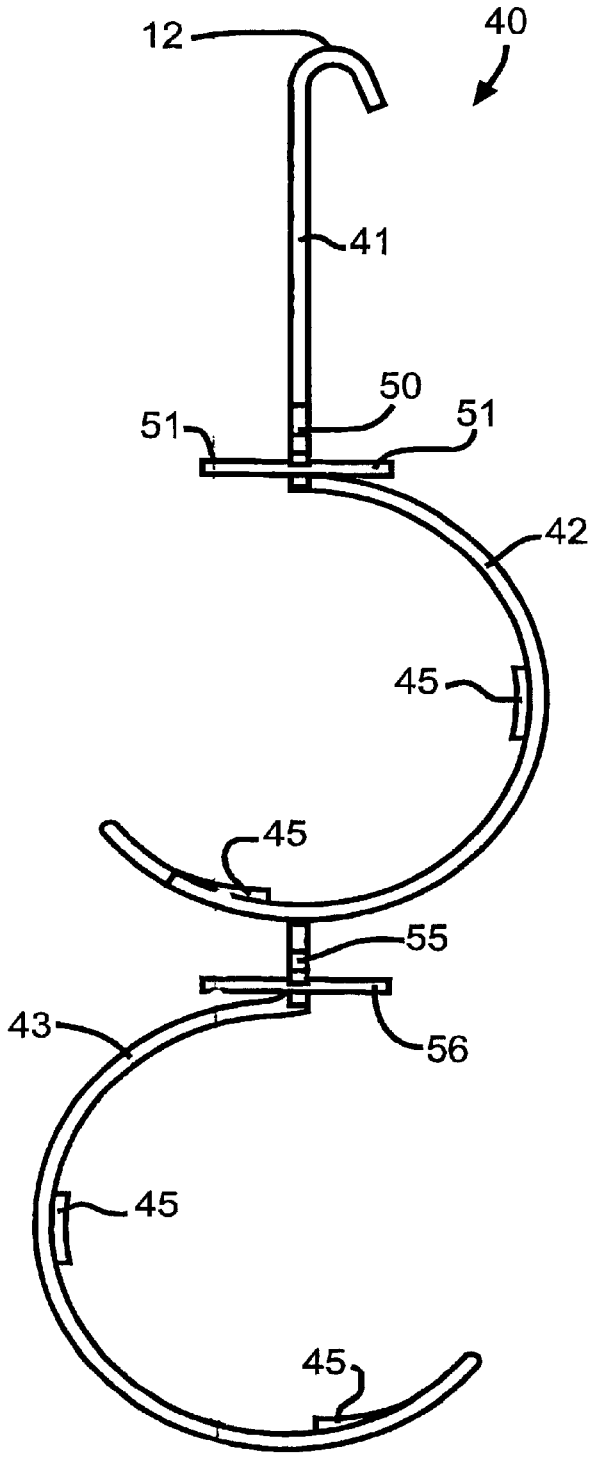
FIG. 2 is a front view of an universal transport hook for a vehicle wheel which is in accordance with the invention.
Figure 3:
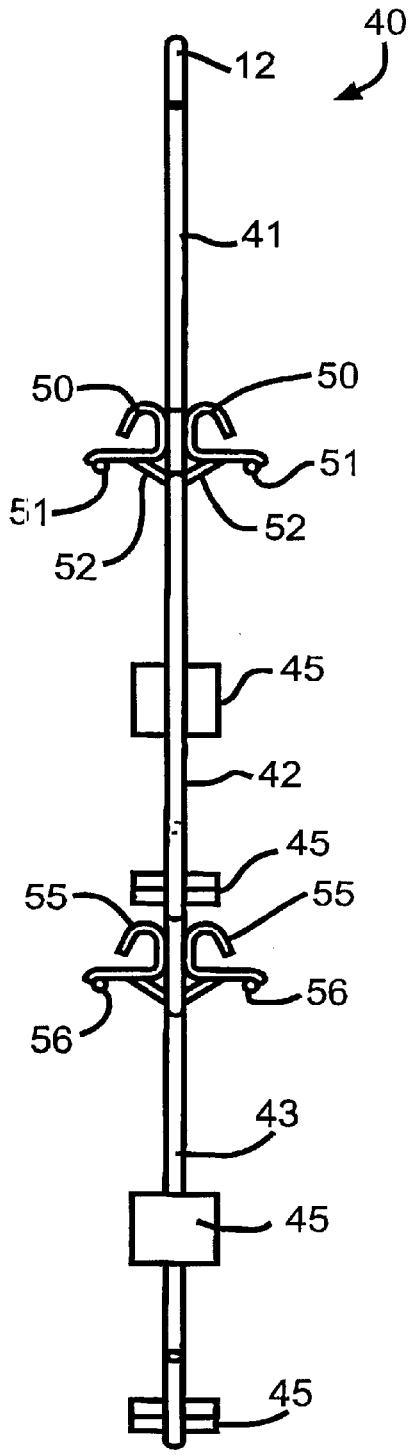
FIG. 3 is a right side view of the transport hook shown in FIG. 2.

Referring again to the drawings, a universal hook in accordance with the invention is illustrated generally at 40 in FIGS. 2 and 3. In the preferred embodiment, the hook 40 is formed from stainless steel to provide durability while transporting wheels through the paint pretreatment portion of the wheel manufacturing facility; however, the hook 40 also can be formed from other materials, such as steel or plastic. The hook 40 includes a suspension hook 12 formed upon an upper end of a straight spacer portion 41. The length of the spacer portion 41 is selected to position the hook 40 at the proper height above the facility floor. The lower portion of the hook 40 is formed into upper and lower C-shaped motorcycle wheel cradles, 42 and 43, respectively. In the preferred embodiment, the inside diameter of the C-shaped cradles 42 and 43 is 17 inches which allows receipt of either 16 inch or 17 inch motorcycle wheels; however, the cradles 42 and 43 also can be formed having other diameters. A pair of transverse retaining pads 45 are mounted upon each of the motorcycle wheel cradles, 42 and 43. While the preferred embodiment includes a pair of retaining pads 45, it will be appreciated that the invention also can be practiced with more or less retaining pads mounted upon each of the C-shaped cradles 42 and 43.

The retaining pads 45 cooperate with the cradles 42 and 43 to retain two motorcycles wheels (not shown) upon the hook 40. The motorcycle wheels are inserted into the open end of the C-shaped cradle 42 and 43 and the tire bead retaining flanges extend over the retaining pads 45 in similar manner as described above for the prior art motorcycle wheel hook 30. It is contemplated that the cradles 42 and 43 can carry either an unfinished motorcycle wheel casting or a completely finished motorcycle wheel which has been machined.

The universal hook 40 also includes a pair of generally J-shaped upper wheel retaining clip hooks 50. The clip hooks 50 extend from universal hook body 41 in a direction which is perpendicular to the plane formed by the C-shaped cradles 42 and 43. In the preferred embodiment, the clip hook opening is formed sufficiently wide to receive the flange of either an automobile wheel casting or a finished automobile wheel. A transverse retaining bar 51 is mounted upon the lower end of each of the retaining clip hooks 50. A support bracket 52 extends from the hook body 41 to each of the retaining hooks 50. The retaining clip hooks 50 cooperate with the retaining bar to secure the tire bead retaining flange of an automobile wheel upon the universal hook 40. The end of the retained wheel rests upon the upper C-shaped cradle 42 of the universal wheel hook 40. As can be seen from FIG. 3, the upper clip hooks 50 can support two wheels in a back-to-back configuration (not shown). While the preferred embodiment includes a pair of retaining clip hooks 50, it will be appreciated that the invention also can be practiced with a single clip hook 50 and retaining bar 51 mounted upon the body portion 41 (not shown).

Similarly, a pair of lower wheel retaining clip hooks 55 and retaining bars 56 are attached to the universal hook 40 between the upper and lower C-shaped cradles 42 and 43. As described above, it is contemplated that the lower wheel retaining clip hooks and bars 55 and 56 would support two more automobile wheels (not shown). Thus, in the preferred embodiment, the universal wheel hook 40 can carry a maximum of two motorcycle wheels or four automobile wheels.

The universal hook 40 has advantage of doubling the carrying capacity of each individual hook. Also, the universal hook 40 can carry both automobile wheels and motorcycle wheels, thus replacing three prior art hooks with a single hook and eliminating the need to change hooks and store hooks within the wheel manufacturing facility. It is also expected that the universal hook 40 will provide improved ergonomics for clearing paint powder from the wheel mounting surface and lug bolt holes. The support bars 24 of the prior art hook 20 may block these areas from being cleared.

Figure 4:
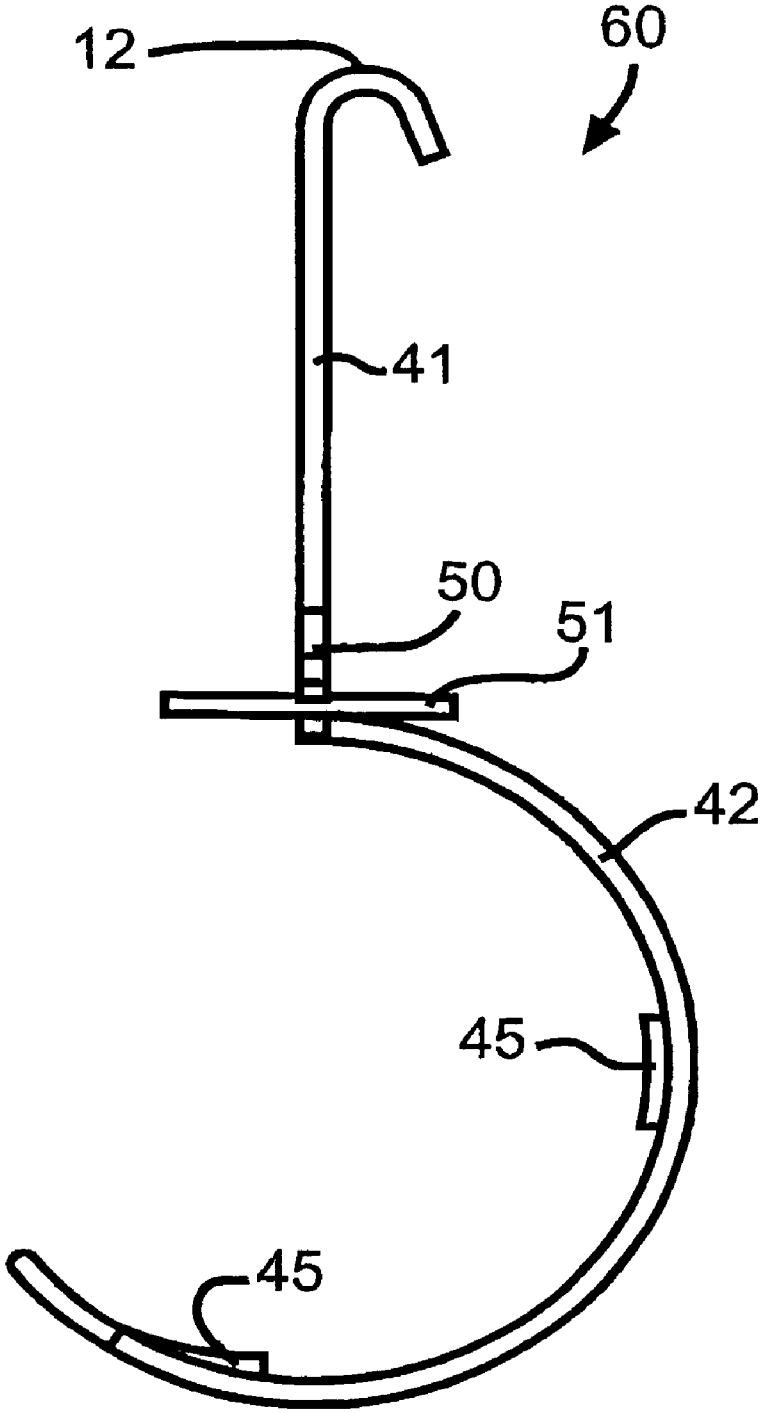
FIG. 4 is an alternate embodiment of the transport hook shown in FIG. 2.

While the preferred embodiment of the invention has been illustrated and described for a hook which can carry two motorcycle wheels, it will be appreciated that the invention also can be practiced to carry more or less wheels. For example, an alternate embodiment of the universal hook is shown generally at 60 in FIG. 4 which would carry one motorcycle wheel or two automobile wheels. Components of the hook 60 which are similar to components of the hook 40 shown in FIGS. 2 and 3 have the same numerical designators. Similarly, by adding more C-shaped sections, it is possible to form a universal hook (not shown) which could carry three or more motorcycle wheels and six or more automobile wheels.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope. For example, the invention also can be practiced without the retaining clips and bars to provide a transport hook for only motorcycle wheels.

What is claimed is:

1. A universal wheel transporting hook comprising: a body portion having a first end formed as a suspension hook and a second end formed as a C-shaped cradle having an open end, said suspension hook and cradle defining a plane;

at least one retaining pad mounted upon said C-shaped cradle;

at least one retaining clip hook attached to said body portion between said suspension hook and said C-shaped cradle, said retaining clip hook extending in a generally perpendicular direction from said plane defined by said suspension hook and cradle; and a retaining bar mounted transversely upon said retaining clip hook.

2. A universal hook according to claim 1 further including a plurality of retaining clips attached to said body portion.

3. A universal hook according to claim 1 wherein said body portion also includes a spacer portion formed between said suspension hook and said C-shaped cradle.

4. A universal hook according to claim 3 wherein said retaining clip hook is attached to said spacer portion adjacent to said C-shaped cradle.

5. A universal hook according to claim 4 wherein said retaining clip hook has a general S-shape, said retaining clip hook having a first end which is attached to said body portion with said first end defining an opening sufficient to receive a tire bead retaining flange of a wheel.

6. A universal hook according to claim 5 wherein said retaining bar is attached to a second end of said retaining clip hook, said second end being opposite from said first end, said retaining bar cooperating with said retaining clip hook to retain a wheel upon the hook.

7. A universal hook according to claim 6 wherein the hook is formed from stainless steel.

8. A universal hook according to claim 7 further including a plurality of retaining pads attached to said C-shaped cradle.

9. A universal hook according to claim 5 including a plurality of retaining clip hooks.

10. A universal hook according to claim 1 further including a plurality of retaining pads attached to said C-shaped cradle.

11. A universal motorcycle wheel transporting hook comprising:

a body portion having a first end formed as a suspension hook and a second end formed as a C-shaped cradle having an open end, said suspension hook and cradle defining a plane, said open end of said cradle adapted to receive and support a motorcycle wheel oriented to be coplanar with said plane defined by said suspension hook and cradle; and at least one retaining pad mounted upon said C-shaped cradle, said retaining pad extending in a generally perpendicular direction from sail plane defined by said suspension hook and cradle.

12. A universal hook according to claim 11 wherein said body portion also includes a spacer portion formed between said suspension hook and said C-shaped cradle.

13. A universal hook according to claim 12 further including a plurality of retaining clips attached to said body portion.

* * * * *